US005675845A

United States Patent [19]

Martin et al.

[11] Patent Number: 5,675,845

[45] Date of Patent: Oct. 14, 1997

[54] SPRAY DISPENSER ACTUATED BY TOILET FLUSHING FUNCTION

[75] Inventors: Robert F. Martin, 3550 SW. 210th Ave., Dunnellon, Fla. 34431-3515; Lawerence E. Batt, Dunnellon, Fla.

[73] Assignee: Robert F. Martin, Dunnellon, Fla.

[21] Appl. No.: 460,382

[22] Filed: Jun. 2, 1995

[51] Int. Cl.[6] ..... E03D 9/02

[52] U.S. Cl. ..... 4/228.1

[58] Field of Search ..... 4/228.1; 269/254 R, 269/275, 287; 24/3.8, 3.13, 129 D

[56] References Cited

U.S. PATENT DOCUMENTS

| | | | |
|---|---|---|---|
| 2,257,559 | 9/1941 | Albertson | 24/129 D |
| 2,866,472 | 12/1958 | Risely . | |
| 3,013,699 | 12/1961 | Meuwly . | |
| 3,093,835 | 6/1963 | Kaplan . | |
| 3,172,178 | 3/1965 | Copell | 24/3.13 |
| 3,739,944 | 6/1973 | Rogerson . | |
| 4,064,573 | 12/1977 | Calderone . | |
| 4,358,860 | 11/1982 | Church . | |
| 4,625,342 | 12/1986 | Gangnath et al. | 4/228.1 |
| 4,670,916 | 6/1987 | Bloom . | |
| 4,736,470 | 4/1988 | Classon . | |
| 4,852,221 | 8/1989 | Antonucci | 24/3.13 X |
| 4,901,402 | 2/1990 | Begemann | 24/129 D |

FOREIGN PATENT DOCUMENTS

| | | |
|---|---|---|
| 2672621-A1 | 8/1992 | France . |

*Primary Examiner*—Charles E. Phillips

*Attorney, Agent, or Firm*—Shlesinger, Arkwright & Garvey LLP

[57] ABSTRACT

An apparatus for dispensing a spray responsive to actuation of a flush toilet includes a spray dispenser for dispensing a spray, and an electrical actuator associated with the spray dispenser for operating the spray dispenser. There is a tilt switch electrically connected to the electrical actuator for switching the actuator on, and a connector attached to the tilt switch for attaching the actuation element to a flush toilet. The connector is free of moving parts.

3 Claims, 2 Drawing Sheets

SPRAY DISPENSER ACTUATED BY TOILET FLUSHING FUNCTION

FIELD OF THE INVENTION

This invention relates to a sprayer actuated by movement of an object. More particularly, this invention relates to a sprayer actuated by the operation of a toilet.

BACKGROUND OF THE INVENTION

It has long been recognized that there is a need for removing odors and destroying germs in public restrooms and private bathrooms.

Many attempts have been made to solve the problem of odors; and germs present in bathrooms.

Examples of prior art devices include U.S. Pat. No. 4,625,342 to Gangnath et al. which discloses a device actuated by toilet flushing for dispensing deodorant. The Gangnath et al. device includes a tilt switch attached to the actuation arm of a conventional toilet by use of a clamp. The Gangnath et al. tilt switch opens and closes an electric circuit for causing a deodorant or fragrance dispensing device to spray. Thus, the Gangnath et al. deodorant dispensing device sprays when the user turns the handle of a toilet.

Other examples of prior art devices include U.S. Pat. No. 2,866,472 to Risely; U.S. Pat. No. 3,013,699 to Meuwly; U.S. Pat. No. 3,093,835 to Kaplan; U.S. Pat. No. 3,739,944 to Rogerson; U.S. Pat. No. 4,064,573 to Calderone; U.S. Pat. No. 4,358,860 to Church; U.S. Pat. No. 4,670,916 to Bloom; U.S. Pat. No. 4,736,470 to Classon; and French Patent Publication No. 2,672,621 of Aug. 14, 1992.

Previous attempts at addressing and solving this germ and odor problem include devices for automatically dispensing deodorant sprays at fixed intervals of time, without the need for any action on the part of the user of the bathroom facility.

Although such automatic deodorant sprayers work, they are expensive to use and maintain, owing to the automatic function thereof. If the fixed period of time for dispensing a deodorant is shortened, large quantities of deodorant are used, even when there is no need for such. If the device is not switched off during periods when the bathroom will be unused, such as overnight when the facility is closed, hours of unnecessary spraying result. Still further, if the time period between automatic sprayings is lengthened, many users will be disturbed by the large accumulation of unpleasant odors during periods of high use of the bathroom facilities.

Thus, there have likewise been attempts to effectively address these problems by providing spray deodorizers which only operate when the bathroom facility is used. Such spray deodorizers often are activated when the user of the toilet flushes the toilet.

However, a common drawback of such devices which operate as a function of the flushing of the toilet is that they are complicated, often have many moving parts, require tools to install, and often are complicated to install.

It is believed that the use of spray deodorizers and germicides is not more widespread given the complicated and expensive nature of known devices.

Accordingly, there is a need for an apparatus for dispensing a spray responsive to the actuation of a flush toilet which overcomes these and other drawbacks of the prior art.

OBJECTS AND SUMMARY OF THE INVENTION

It is an object of the invention to provide a spray dispenser which overcomes the problems and drawbacks of existing systems.

It is another object of the invention to provide a sprayer responsive to the flushing of a toilet which is easier to install than known devices.

It is a further object of the invention to provide a sprayer responsive to the flushing of a toilet which can be installed by hand.

It is yet another object of the invention to provide a sprayer responsive to the flushing of a toilet which can be installed without the use of tools.

It is another object of the invention to provide a sprayer responsive to the flushing of a toilet which uses less energy than known devices.

It is a further object of the invention to provide a sprayer responsive to the flushing of a toilet that requires less maintenance than known devices.

It is a still further object of the invention to provide a sprayer responsive to the flushing of a toilet which has fewer moving parts than known devices.

It is a yet still further object of the invention to provide a sprayer responsive to the flushing of a toilet that is more environmentally friendly than known devices, owing to its dispensing a spray only when needed.

It is another object of the invention to provide a sprayer responsive to the flushing of a toilet that requires no changes to be made to the flushing mechanism of a conventional toilet.

It is yet another object of the invention to provide a sprayer disposed at a distance from the tank of a toilet and which has its actuating mechanism disposed in the tank of a conventional toilet, and yet which is more water resistant and waterproof than known devices.

It is another object of the invention to provide a method of connecting a spray dispenser to a flush toilet that is easier to perform, less expensive to carry out, and requires less down time of the bathroom facilities.

A still further object of the invention is to provide a sprayer responsive to the flushing of a toilet that can be installed by elderly and physically challenged persons.

In summary, therefore, in one preferred embodiment the invention is directed to an apparatus for dispensing a spray responsive to actuation of a flush toilet that includes a spray dispenser for dispensing a spray, and an electrical actuator associated with the spray dispenser for operating the spray dispenser. There is a tilt switch electrically connected to the electrical actuator for switching the actuator on, and a connector attached to the tilt switch for attaching the actuation element to a flush toilet. The connector is free of moving parts.

In another preferred embodiment, the invention is directed to an apparatus for dispensing a spray responsive to actuation of a flush toilet that includes a spray dispenser for dispensing a spray, and an electrical actuator associated with the spray dispenser for operating the spray dispenser. There is a tilt switch electrically connected to the electrical actuator for switching the actuator on, and a connector attached to the tilt switch for attaching the actuation element to a flush toilet. The connector includes a flexible material for engaging the actuation element of a flush toilet.

In one preferred embodiment of a method according to the invention, the method of connecting a spray dispenser to a flush toilet, includes:

1. providing an apparatus for dispensing a spray responsive to actuation of a flush toilet. The apparatus includes: a spray dispenser for dispensing a spray, an electrical actuator operatively associated with the spray dispenser for operating the spray dispenser, a tilt switch electrically connected to the electrical actuator for switching the actuator on, a connector attached to the tilt switch, the connector being configured for being attached to an actuation element of a flush toilet, the connector including a material sufficiently flexible for engaging and conforming to an actuation element of a flush toilet;

2. removing a lid from a tank of a flush toilet; and 3. attaching the connector to an actuation element of a flush toilet by hand.

The invention will now be described with reference to the drawings.

DETAILED DESCRIPTION OF THE INVENTION

Figure 1:
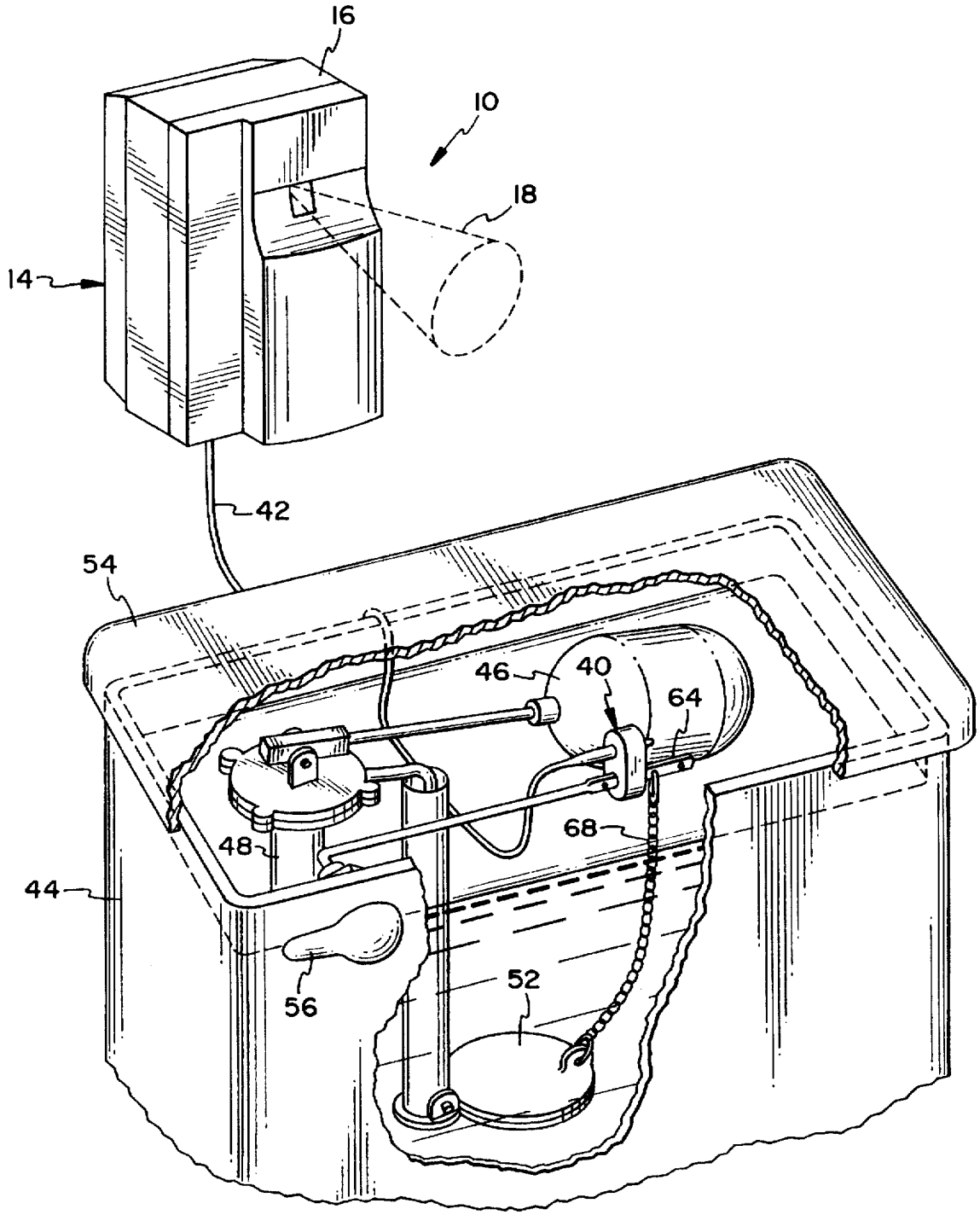
FIG. 1 is a perspective view of a sprayer responsive to actuation of a flush toilet provided on a conventional flush toilet.
Figure 4:
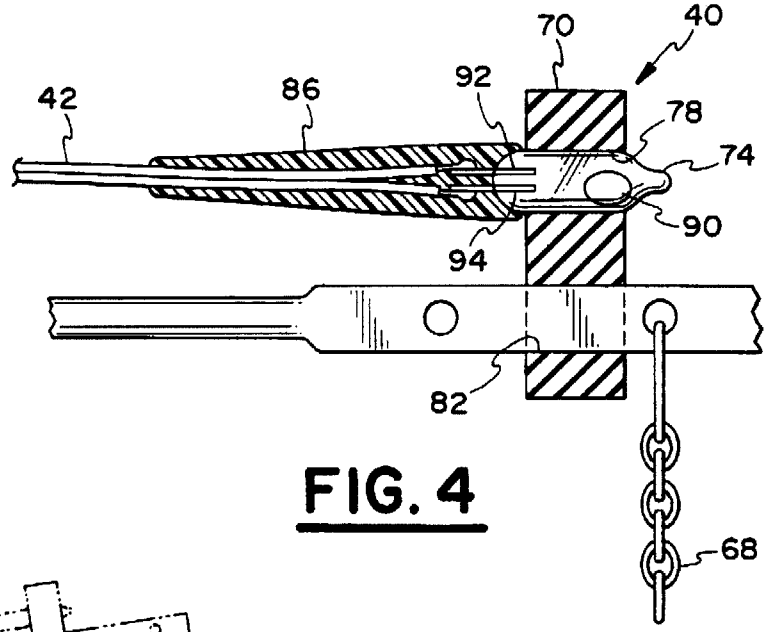
Figure 2:
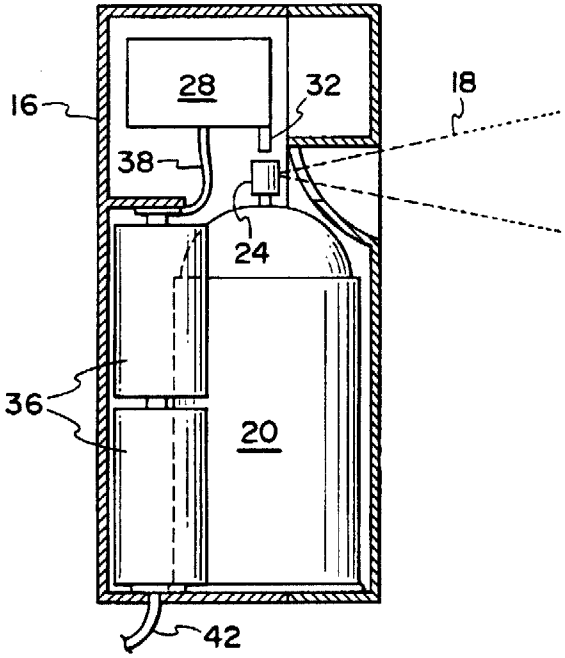
FIG. 2 is a cross-sectional view of a sprayer according to the invention.

FIGS. 1–4 illustrate an embodiment of an apparatus 10 for dispensing a spray responsive to actuation of a flush toilet.

Apparatus 10 includes a sprayer 14 which may have a housing 16 through which a spray 18 exits.

Conveniently, a standard aerosol can 20 may be disposed in housing 16 for producing spray 18. Such conventional aerosol cans 20 are provided with a valve 24 which, when depressed, release a fragrance or germicide along with a carrier in the form of spray 18.

Releasing valve 24 closes the valve and the spraying ceases.

Thus, automatic actuation of sprayer 14 is achieved by providing an actuator 28 having an actuating element 32 adjacent aerosol can 20. Actuating element 32 is constructed for depressing and releasing valve 24 when actuator 28 dictates.

A power source 36, such as two dry cell batteries, supplies power to actuator 28 through electrical wires 38.

A switch 40, which may be a conventional tilt switch or mercury switch, is wired to power source 36 by electrical wires 42. Tilt switch 40 completes (and breaks) the electrical connection between power source 36 and actuator 28; in other words, tilt switch 40 turns actuator 28 on and off.

Goods results have been achieved when apparatus 10 is attached to a conventional toilet having a tank 44 which stores a volume of water until the toilet is used.

A conventional float 46 governs the operation of an inlet valve 48 which lets in water from a standard, pressurized supply, and an outlet valve 52 governs the release of the water stored in tank 44 into the unillustrated toilet bowl when a handle 56 is pushed. A lid 54 covers tank 44.

Handle 56 operates outlet valve 52 by means of a lever arm or actuator element 58 having a free end 62 distant from handle 56. Conventionally, one or more holes 64 is provided adjacent free end 62 and such holes 64 serve to attach a chain or other connection element 68 to outlet valve 52.

A connector 70 has been successfully used to attach tilt switch 40 to free end 62 of arm 58.

An upper hole 78 may be provided in connector 70 for receiving tilt switch 40, and a lower hole 82 may be provided for receiving free end 62. A seal 86, such as electrical tape, adhesive, epoxy, or a heat-shrink plastic, may be provided around the connection between tilt switch 40 and wire 42.

Good results have been achieved when a mercury switch was used as tilt switch 40. The mercury switch has a volume of mercury 90 (in other words, a "bead" or "ball" of mercury) therein which is disposed at a distance from leads 92 and 94 of wire 42 when tilt switch 40 is in its "off" position. The off position of switch 40 is shown in the lower, solid line view of FIG. 3, as well as in the enlarged view of FIG. 4. Switch 40 is shown in its "on" position in phantom line in FIG. 3. In the on position of switch 40, the electrical circuit will be completed by whatever type of switching element is being used. In the case of the illustrated mercury switch, the ball of mercury 90 will contact both lead 92 and lead 94 in its on position, thereby completing the circuit.

Given that most mercury switches are encased in glass, a fragile material, connector 70 has successfully been made sufficiently large to not only secure switch 40 relative to lever arm 58, but also to encase switch 40 as well as to provide a shock absorbing function. Thus, a grommet made of a rubber material has been successfully used. It is contemplated that other synthetic materials be used for connector 70.

The use of a synthetic material for connector 70 has the added advantage that no metallic components subject to oxidation and rust are exposed to the high humidity environment inside tank 44.

As will be readily appreciated, tank 44 is generally continuously partially filled with water, and the air space between the top surface of the water and the lid has a high relative humidity. In addition, when movement of handle 56 has caused the toilet to flush, there is frequently splashing of water as the water exits tank 44, and as water enters tank 44 to refill the tank at the end of the flushing cycle.

The use of a flexible material for connector 70 ensures that connector 70 is securely attached to lever arm 58 when mounted by hand, even without the use of tools.

OPERATION

Briefly, the operation of apparatus 10 according to the invention is as follows.

Figure 3:
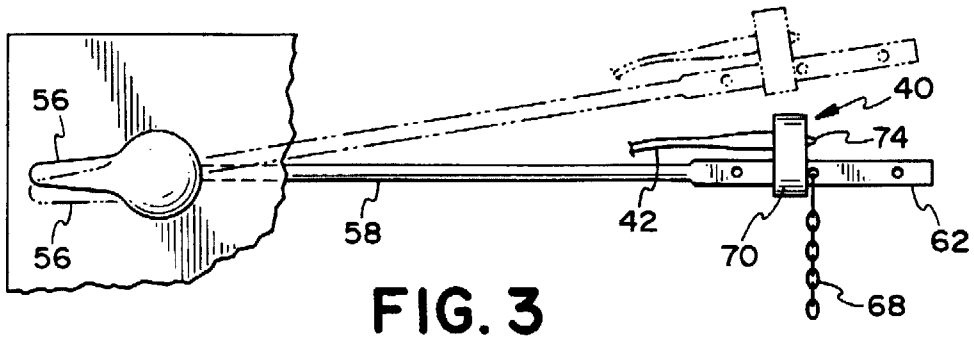
FIG. 3 is a view of a tilt switch and connector according to the invention at rest, and in a moved position; and, FIG. 4 is a sectional view of the tilt switch and connector according to the invention on an enlarged scale.

The user turns handle 56, lever arm 58 rotates, and switch 40 moves from its solid line resting "off" position to the phantom line "on" position shown in FIG. 3.

In its on position, switch 40 completes the electrical circuit, and power source 36 causes actuator 28 to push valve 24 down by means of actuating element 32.

Thus, depressed valve 24 releases spray 18 from aerosol can 20.

Releasing handle 56 allows lever arm 58 along with switch 40 to return to the solid line resting position of FIG. 3. Switch 40 is now in its "off" position. Actuator 28 is thus deengergized, actuating element 32 returns to its rest position, as does valve 24 of aerosol can 20.

The method of installing apparatus 10 on a conventional toilet is as follows.

The user places sprayer 14 in the desired location, orienting sprayer 14 so that spray 18 discharges in a desired direction. The toilet lid is removed from tank 44, and the user disconnects chain 68 from free end 62, as required. Hole 82 is aligned with free end 62, and the user pushes connector 70 onto lever arm 58.

Given that no tools are required for installation, thanks to the flexible nature of the materials selected for connector 70, physically challenged individuals, including those having arthritis, can install connector 70. Connector 70 can be installed on either side of chain 68. In the case where chain 68 is attached to lever arm 58 between connector 70 and free end 62, chain 68 prevents connector 70 from falling off free end 62 of lever arm 58 in the event that the connection between connector 70 and lever arm 58 loosens.

The user simply locates wire 42 away from moving parts, runs wire 42 over the upper edge of tank 44, and replaces lid 54 on the tank. The tank lid 54 may rest on wire 42, and the user need not drill any holes in the tank 44 or lid 54.

A working model of our invention has been constructed using an electrically powered deodorant dispenser or sprayer made in accordance with U.S. Pat. No. 3,739,944 to Rogerson, which is incorporated herein by reference. The model of the electrical sprayer which was modified is a Time Mist Model No. 1000 designed to actuate a replaceable aerosol can (Part #33-2961TM) manufactured by Waterbury Companies, Inc. of Waterbury, Conn. 06722.

That current model of the sprayer included a timer, along the lines described in the Rogerson '944 patent, for periodically discharging a metered quantity of spray from the aerosol container. We removed the timing device and wired our tilt switch directly to the actuating device so that our sprayer discharges deodorant or germicidal spray only when the toilet to which our invention is attached is flushed. Thus, our working model of the invention saves electricity and/or reduces the need to replace batteries frequently, as there is electrical demand for discharging the spray only when needed. It is contemplated that a timer be used in conjunction with the tilt switch so that the user could actuate a timer, as desired.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

We claim:

1. An apparatus for dispensing a spray responsive to actuation of a handle of a flush toilet of the type having an actuation element connected to the toilet handle, said apparatus comprising:

a) a spray dispenser for dispensing a spray;

b) an electrical actuator disposed substantially adjacent to and operatively associated with said spray dispenser for actuating said spray dispenser;

c) a tilt switch electrically connected to said electrical actuator for switching said electrical actuator on;

d) said tilt switch including a mercury switch encased in glass;

e) a connector in the form of a grommet made of a flexible material, said connector having an upper hole extending therethrough and a lower hole extending therethrough, said upper hole being of a size so as to encase the glass portion of said tilt switch such that said connector will provide a shock absorption function therefore, said lower hole being of such a size as to receive said actuation element in such a manner as to secure said connector and said tilt switch to said actuation element;

f) whereby, when said flexible connector is attached to the actuation element of a flush toilet with said tilt switch encased in said connector, said mercury switch will complete an electrical circuit when the handle of the flush toilet is actuated, thus causing said electrical actuator to be actuated.

2. An apparatus as defined in claim 1, wherein:

a) said connector is a rubber grommet.

3. An apparatus as defined in claim 1, wherein:

a) said connector includes a synthetic material.

* * * * *